US008789476B1

(12) United States Patent
Kryman

(10) Patent No.: US 8,789,476 B1
(45) Date of Patent: Jul. 29, 2014

(54) DISPOSABLE FOOD CONTACT ARTICLE WITH LIGHT REFLECTIVE DESIGN

(71) Applicant: Jacob Kryman, Brooklyn, NY (US)

(72) Inventor: Jacob Kryman, Brooklyn, NY (US)

(73) Assignee: KCH Corporation, Brooklyn, NY (US)

( * ) Notice: Subject to any disclaimer, the term of this patent is extended or adjusted under 35 U.S.C. 154(b) by 0 days.

(21) Appl. No.: 13/759,232

(22) Filed: Feb. 5, 2013

(51) Int. Cl.
*A47B 13/08* (2006.01)
*A47G 19/03* (2006.01)

(52) U.S. Cl.
CPC ..... *A47G 19/03* (2013.01)
USPC ..... 108/90

(58) Field of Classification Search
USPC ..... 108/90, 25, 26
See application file for complete search history.

(56) References Cited

U.S. PATENT DOCUMENTS

| | | | | | |
|---|---|---|---|---|---|
| 3,926,439 | A * | 12/1975 | Chao et al. | 273/237 |
| 4,500,129 | A * | 2/1985 | Hahn | 294/172 |
| 4,991,978 | A * | 2/1991 | Ostrowski | 383/4 |
| 5,069,554 | A * | 12/1991 | Bonnett | 108/90 |
| 5,312,656 | A * | 5/1994 | Michaels | 428/13 |
| D366,780 | S * | 2/1996 | Brooks | D6/406.3 |
| 5,794,935 | A * | 8/1998 | Lo | 273/309 |
| 6,808,071 | B2 * | 10/2004 | Brown | 108/90 |
| 7,104,201 | B2 * | 9/2006 | Comeaux et al. | 108/90 |
| D546,096 | S * | 7/2007 | Kreiss | D6/480 |
| 8,117,971 | B1 * | 2/2012 | Cotton et al. | 108/90 |
| 2004/0003760 | A1 * | 1/2004 | O'Connell et al. | 108/26 |
| 2010/0132595 | A1 * | 6/2010 | Gledhill | 108/90 |

* cited by examiner

*Primary Examiner* — Jose V Chen
(74) *Attorney, Agent, or Firm* — Dekel Patent Ltd.; David Klein

(57) ABSTRACT

A disposable food contact article includes a food-contact member having a food surface for contacting food. A peripheral border extends from the food surface, and the peripheral border includes a plurality of design elements which are more light-reflective than a remainder of the peripheral border.

7 Claims, 1 Drawing Sheet

DISPOSABLE FOOD CONTACT ARTICLE WITH LIGHT REFLECTIVE DESIGN

FIELD OF THE INVENTION

The present invention generally relates to disposable food contact articles and more specifically to a disposable food contact article with a light reflective design.

BACKGROUND OF THE INVENTION

Many disposable food contact articles are known, such as plates, dishes, bowls, and other tableware. Typically, such articles are made of an opaque, food-compatible plastic, which may be colored and have different designs printed or embossed or otherwise formed thereon.

SUMMARY OF THE INVENTION

The present invention seeks to provide a novel disposable food contact article with a light reflective design, as is described more in detail hereinbelow.

There is thus provided in accordance with a non-limiting embodiment of the present invention a disposable food contact article including a food-contact member having a food surface for contacting food, and a peripheral border extending from the food surface, the peripheral border including a plurality of design elements which are more light-reflective than a remainder of the peripheral border.

In accordance with an embodiment of the present invention the design elements protrude from the peripheral border.

In accordance with an embodiment of the present invention the peripheral border has a top side which faces in a same direction as the food surface, and the design elements protrude from an underside of the peripheral border opposite to the top surface.

In accordance with an embodiment of the present invention the light-reflective design elements are additionally on an underside of the food surface.

The food-contact member may be transparent or translucent. The design elements may be colored differently from the food surface and/or the peripheral border.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
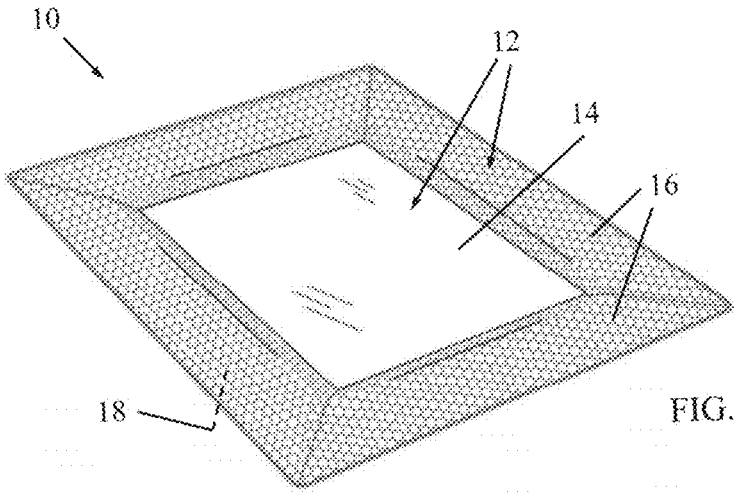
FIGS. 1 and 2 are simplified perspective illustrations of disposable food contact articles, in accordance with an embodiment of the present invention.

Reference is now made to FIG. 1, which illustrates a disposable food contact article 10, in accordance with a non-limiting embodiment of the present invention.

The disposable food contact article 10 is illustrated as a plate, but may be a dish, bowl, serving vessel, cutlery, etc.

The disposable food contact article 10 has a food-contact member 12, which has a food surface 14 for contacting food.

A peripheral border 16 extends from food surface 14. The peripheral border 16 includes a plurality of design elements 18 which more light-reflective than the rest of the peripheral border 16. Design elements 18 may be of any size and shape, such as but not limited to, spherical, triangular, irregular, polygonal, and many others.

Figure 2:
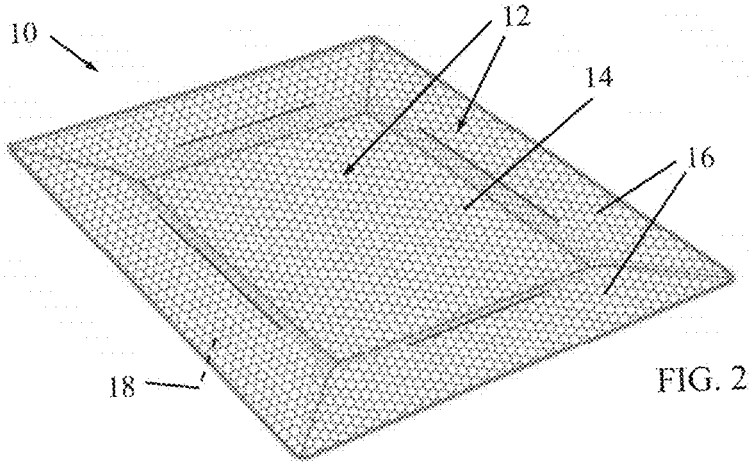
Figure 3:
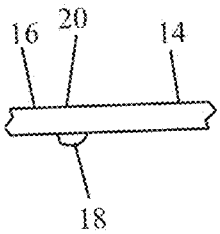
FIG. 3 is a simplified side-view illustration of the food contact article, showing light-reflective design elements on the underside of the article, in accordance with an embodiment of the present invention.

As seen in FIG. 3, peripheral border 16 has a top surface 20 which faces in a same direction as the food surface 14. The design elements 18 protrude from the underside of the peripheral border 16 opposite to the top surface 20. Light shining from above passes through peripheral border 16 (in the case of FIG. 2, the same holds true of food surface 14) and is reflected from design elements 18, thereby providing an aesthetic appearance. The light may be reflected in multiple directions or in only a few directions.

As seen in FIG. 2, in accordance with another embodiment of the present invention, the light-reflective design elements 18 are additionally on an underside of the food surface 14.

Different optical effects may be obtained. For example, the food-contact member 12 may be transparent or translucent. The design elements 18 may be colored differently from the food surface 14 and/or the peripheral border 16.

The scope of the present invention includes both combinations and subcombinations of the features described hereinabove as well as modifications and variations thereof which would occur to a person of skill in the art upon reading the foregoing description and which are not in the prior art.

What is claimed is:

1. A disposable food contact article comprising:

a food-contact member having a food surface for contacting food;

a peripheral border extending from said food surface, said peripheral border having a top surface which faces in a same direction as said food surface and a bottom surface opposite to said top surface, said peripheral border being transmissive to light so that a portion of light shining from above said peripheral border passes through said top surface to said bottom surface; and a plurality of design elements protruding from the bottom surface of said peripheral border, wherein spaces on said bottom surface adjacent to said design elements are called a remainder of the bottom surface of said peripheral border, and wherein said design elements are more light-reflective than said remainder of the bottom surface of said peripheral border, and wherein said portion of light shining from above said peripheral border that passes through said top surface to said bottom surface of said peripheral border passes to said design elements and the remainder of said bottom surface, and more of the light is reflected from said design elements than from said remainder of said bottom surface.

2. The article according to claim 1, wherein said design elements are spherical, triangular, irregular, or polygonal.

3. The article according to claim 1, wherein said light-reflective design elements are additionally on an underside of said food surface.

4. The article according to claim 1, wherein said food-contact member is transparent.

5. The article according to claim 1, wherein said food-contact member is translucent.

6. The article according to claim 1, wherein said design elements are colored differently from said food surface.

7. The article according to claim 1, wherein said design elements are colored differently from said peripheral border.

* * * * *